US007163499B2

(12) United States Patent
Saad

(10) Patent No.: US 7,163,499 B2
(45) Date of Patent: Jan. 16, 2007

(54) APPARATUS FOR WORKING THE ABDOMINAL MUSCLES WHILE PROTECTING THE BACK AND PROMOTING DIAPHRAGMATIC BREATHING

(76) Inventor: Elie Saad, 31 rue Jean-Philippe Rameau, 71600 Paray-le-Monial (FR)

( * ) Notice: Subject to any disclaimer, the term of this patent is extended or adjusted under 35 U.S.C. 154(b) by 0 days.

(21) Appl. No.: 10/474,757

(22) PCT Filed: Apr. 4, 2002

(86) PCT No.: PCT/FR02/01188

§ 371 (c)(1),
(2), (4) Date: Oct. 10, 2003

(87) PCT Pub. No.: WO02/083250

PCT Pub. Date: Oct. 24, 2002

(65) Prior Publication Data

US 2004/0116261 A1 Jun. 17, 2004

(30) Foreign Application Priority Data

Apr. 10, 2001 (FR) ..... 01 04936

(51) Int. Cl.
*A63B 26/00* (2006.01)

(52) U.S. Cl. ..... 482/142; 482/148

(58) Field of Classification Search ..... 482/121–134; 2/1, 243.1, 912; 24/1, 163 R, 455
See application file for complete search history.

(56) References Cited

U.S. PATENT DOCUMENTS 5,647,827 A * 7/1997 Gutkowski et al. ..... 482/124
2003/0114278 A1* 6/2003 Rigas ..... 482/116
2004/0259702 A1* 12/2004 Tung ..... 482/126

* cited by examiner

*Primary Examiner*—Lori Amerson
(74) *Attorney, Agent, or Firm*—William A. Drucker

(57) ABSTRACT

Device for working specifically the abdominal muscles in a staged, global, symmetrical and asymmetrical manner, while protecting the back and encouraging diaphragmatic breathing.

The invention concerns a device permitting the toning up of the abdominal muscles and the gradual prolonging of effort.

It is made up of a lumbar band fixed to two rings divided into three levels by two teeth, braces fixed at together with a strap. When the user pulls the strap inserted in the ring at a chosen level and holds his stomach in while taking a breath, the device supports, in a staged manner, the work of the abdominal muscles, protects the back and aids diaphragmatic breathing.

This device according to the invention is particularly intended for beginners and for people suffering from lumbar pain and obesity.

8 Claims, 8 Drawing Sheets

APPARATUS FOR WORKING THE ABDOMINAL MUSCLES WHILE PROTECTING THE BACK AND PROMOTING DIAPHRAGMATIC BREATHING

BACKGROUND OF THE INVENTION

1. Field of the Invention

The present invention concerns a device for working specifically and easily the abdominal muscles, and more particularly the transverse muscle, in a staged, global, symmetrical and asymmetrical manner, while protecting the back and offering better oxygenation as well as a good amplitude of abdominal work thanks to the diaphragmatic breathing encouraging during exercising. The desired effects with this device are the toning up of the abdominal muscles and the gradual prolonging of muscular effort so as to exceed, thanks to the simplicity and easiness of the training, the duration necessary for this effort to contribute to the reduction of abdominal fat.

2. Description of the Prior Art

Traditionally, to work the abdominal muscles, physical exercises are proposed. Their main drawback is that they call at the same time for effort from other muscles and quickly cause a state of fatigue and discouragement for those who are not used to prolonged physical effort and those who suffer from lumbar pain or obesity. Other instruments, according to their designers, carried in the hands and being applied against the abdominal muscles, work these muscles directly. However, these exercises add to the abdominal work the work of the biceps which must provide a considerable effort and carry the device. In addition, during these exercises, the back is not protected because it alone compensates for the work of the biceps and the abdominal muscles. Similarly, the strength of the arms may well not be symmetrical and would put a strain on one side of the spinal column.

Certain instruments, by electric stimulation, work the abdominal muscles but they do not require physical effort or optimal oxygenation.

OBJECT OF THE INVENTION

The device according to the invention remedies these drawbacks and works specifically and for a long time the abdominal muscles while protecting the back. It comprises, indeed, a wide band referred to hereinafter as the "lumbar band", a strap, two rings and braces.

BRIEF SUMMARY OF THE INVENTION

The lumbar band, made of a flexible, strong material, of fixed width and of variable length according to the sizes (small, medium and large), is placed in this device on the lower back, and fixes to a ring at each of its ends and to the braces by the middle of its top part.

Each ring, made of a rigid material and covering the width of the lumbar band, is divided according to length into three equal parts by two teeth. At the top of the rings are attached adjustable braces to carry the device like a back-pack.

In the various parts of the ring, constituting three stages, there passes a strap made of flexible, strong material, of fixed width and of variable length according to the sizes (small, medium and large).

To work the abdominal muscles, the user, standing or seated, wears the device like a back-pack, adjusts the lumbar band on the lower back and inserts, in the rings, the strap which goes round the abdomen. Then, he takes hold of the two ends of the strap and pulls while taking a breath and trying to hold his stomach in as much as possible. The strap partly supports the work of the abdominal muscles and thus reduces the effort so as to prolong the duration. The device, by the pulling of the strap and the movement of the arms, aids, by combining it with the exercise, diaphragmatic breathing which offers a greater amplitude to the abdominal work and optimal oxygenation. The strap must be released with non-forced breathing in.

Carried out by sliding from one stage to another, the modification of the strap on the rings permits staged specific work in all the abdominal muscles. For symmetrical work, the user places the strap at the same level in the rings. Asymmetrical work can also be done by placing the strap at different levels. In this case, the user must therefore pull on the ends of the strap by crossing his hands over.

The lumbar band, placed as low as possible on the back, tightens at the same time as the strap and permits lumbar correction and protection when working the abdominal muscles.

According to particular embodiments:

The device can be one size but adjustable by adding technical adjusting and fixing features to the lumbar band, to the ring or to both if the technique and the material these elements are made of require it. Thus:

a) The lumbar band can be of fixed length adjustable at the user's waist. The band can be adjusted and fixed on the rings by adding to the band technical fixing and adjusting features such as, by way of a non-exhaustive example, self-fastening fabrics or others.

b) The ring can be joined to an adjusting and fixing mechanism such as, by way of a non-exhaustive example, an adjusting loop for the braces or others.

The rings can also be provided with holes at the top for fixing the straps. Equally, seeing that the shape of the rings does not interfere with the device's functional features, it can vary and be rectangular, trapezoidal, triangular, semi-circular or others The strap can be provided with an adjusting and looping mechanism by adding to it, by way of a non-exhaustive example, a loop and self-fastening fabrics.

BRIEF DESCRIPTION OF THE SEVERAL VIEWS OF THE DRAWINGS

The attached drawings illustrate the invention.

DETAILED DESCRIPTION OF THE INVENTION

Figure 1:
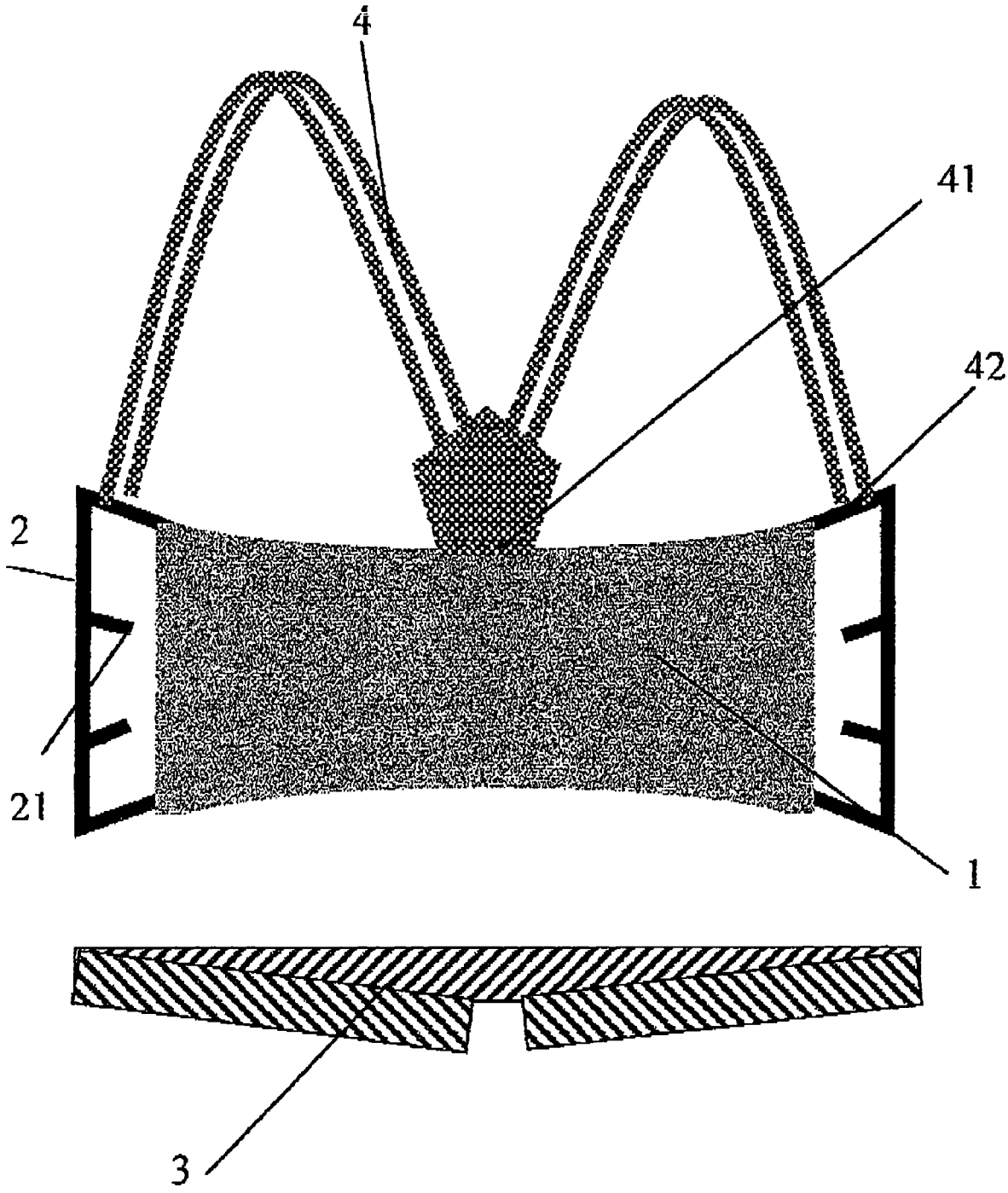
FIG. 1 represents the inner face of the device according to the invention.
Figure 2:
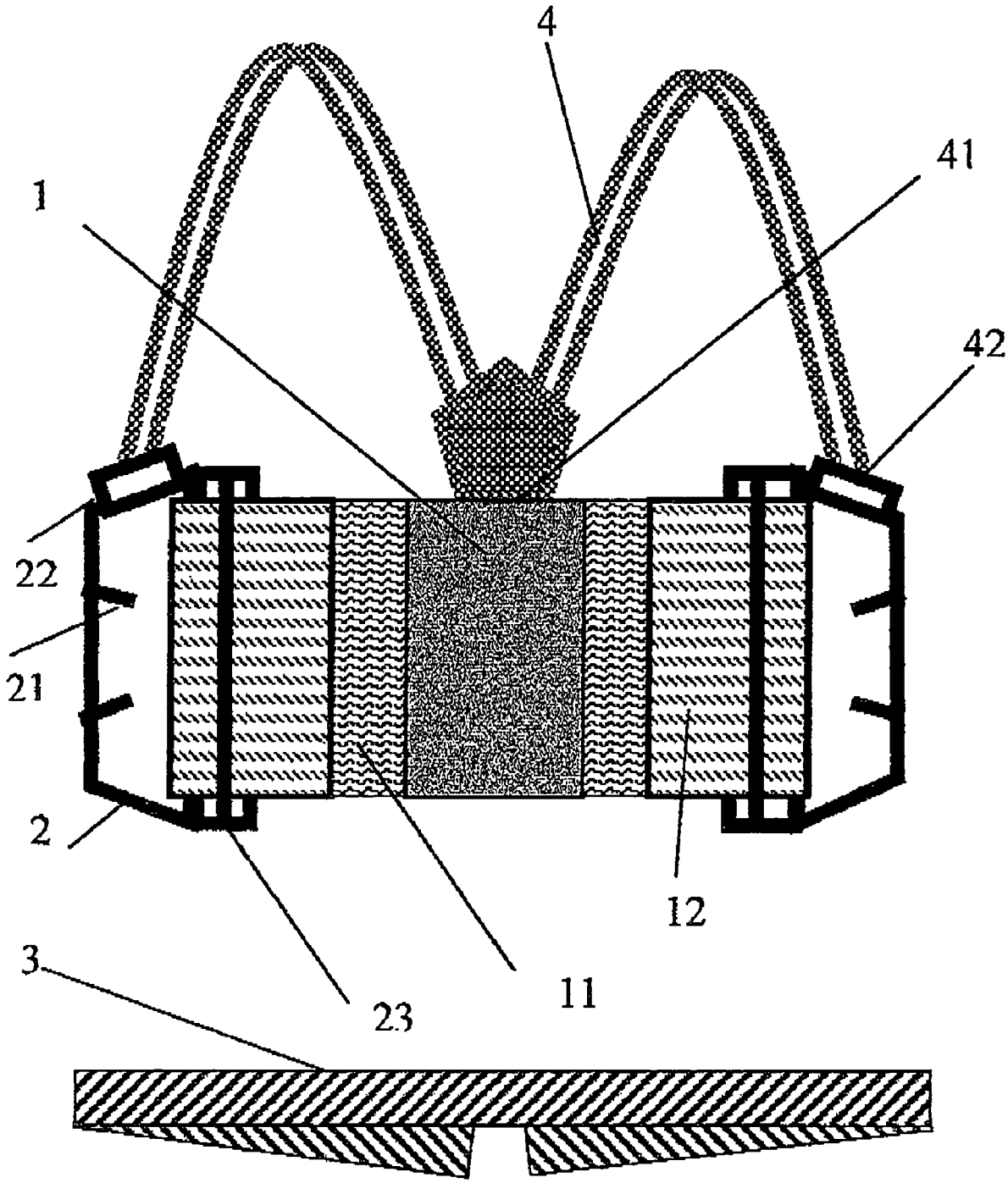
FIG. 2 represents the outer face of a variant of this device.

Referring now to drawings 1, 2 and 6, the device comprises on the one hand a lumbar band (1) made of flexible, strong and non-stretch material which fixes, at each of its ends over the entire width, to a ring (2) and attaches to the braces (4) in the middle of the top part (41). The ring (2) made of rigid material, is divided into three parts by two teeth (21). Adjustable braces (4) to carry the device like a back-pack attach at their ends (42) to the top of the rings. On the other hand, the device also comprises a strap (3) made of flexible, strong and non-stretch material, of fixed width making it possible to pass easily through the parts of the rings. The strap serves to support the muscle work and to tighten the device during exercising.

Figure 3:
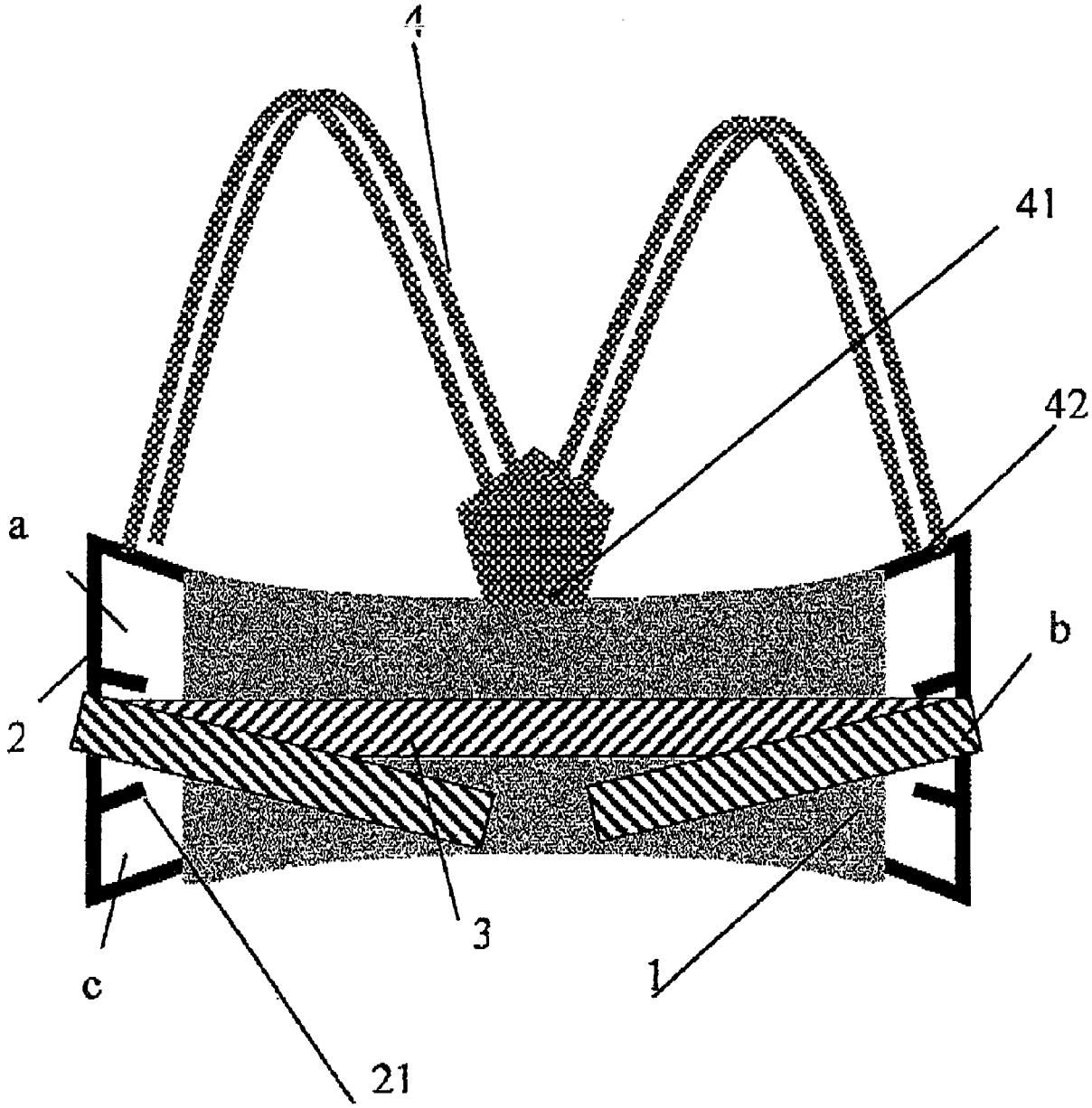
FIG. 3 shows symmetrical work in all the abdominal muscles.
Figure 4:
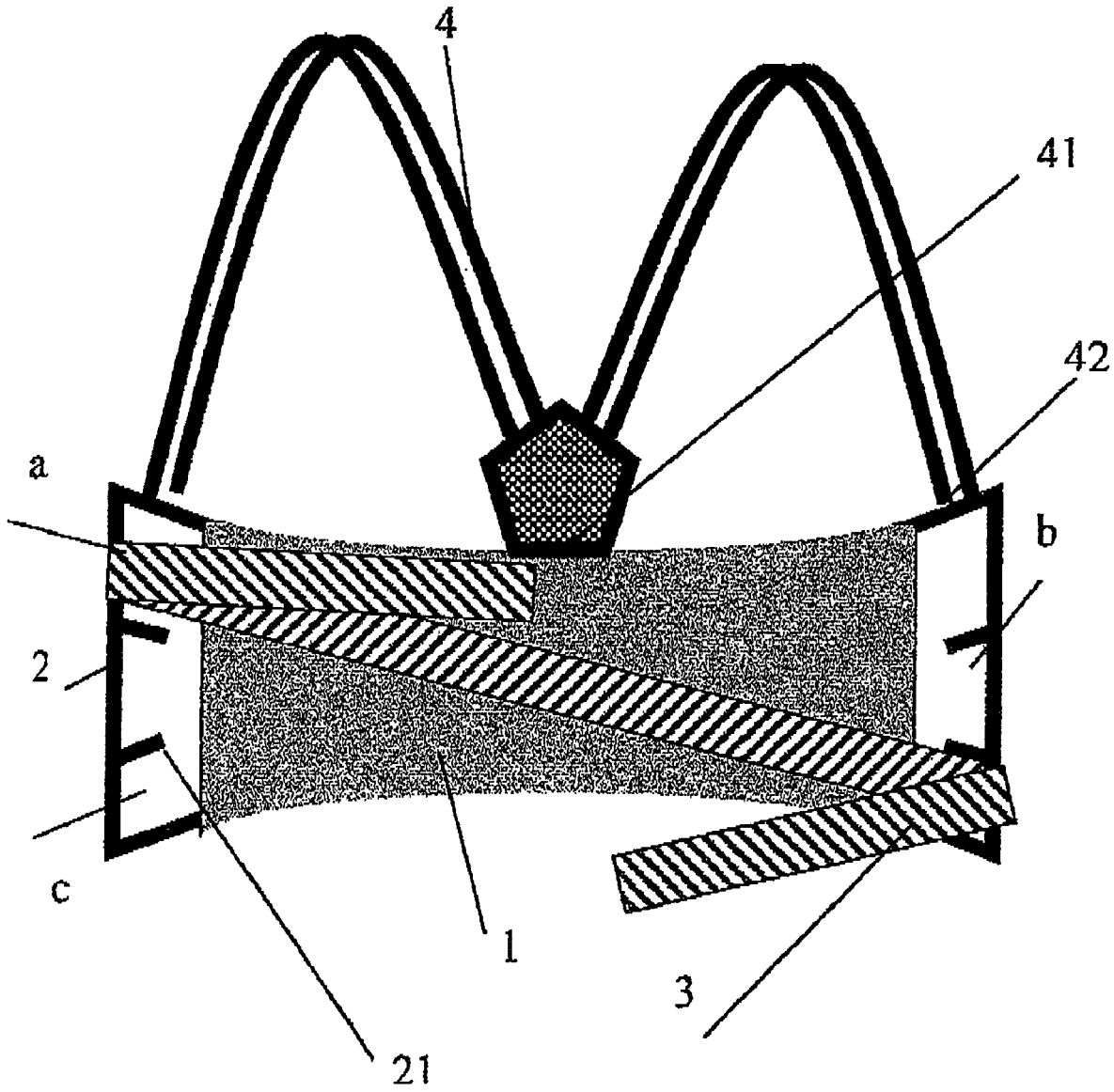
FIG. 4 shows asymmetrical work.
Figure 5:
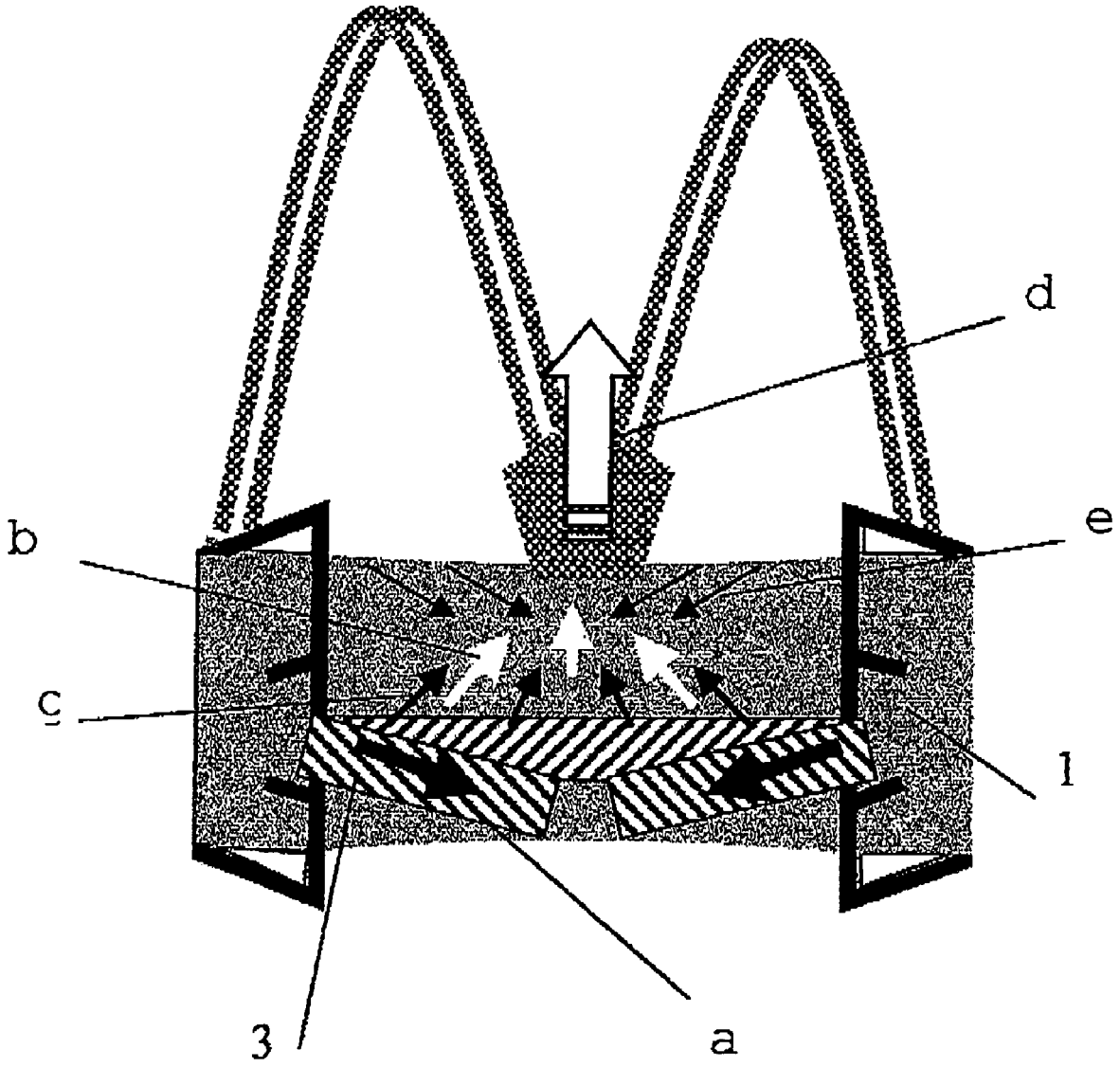
FIG. 5 shows the biomechanical functioning associated with the device.
Figure 6:
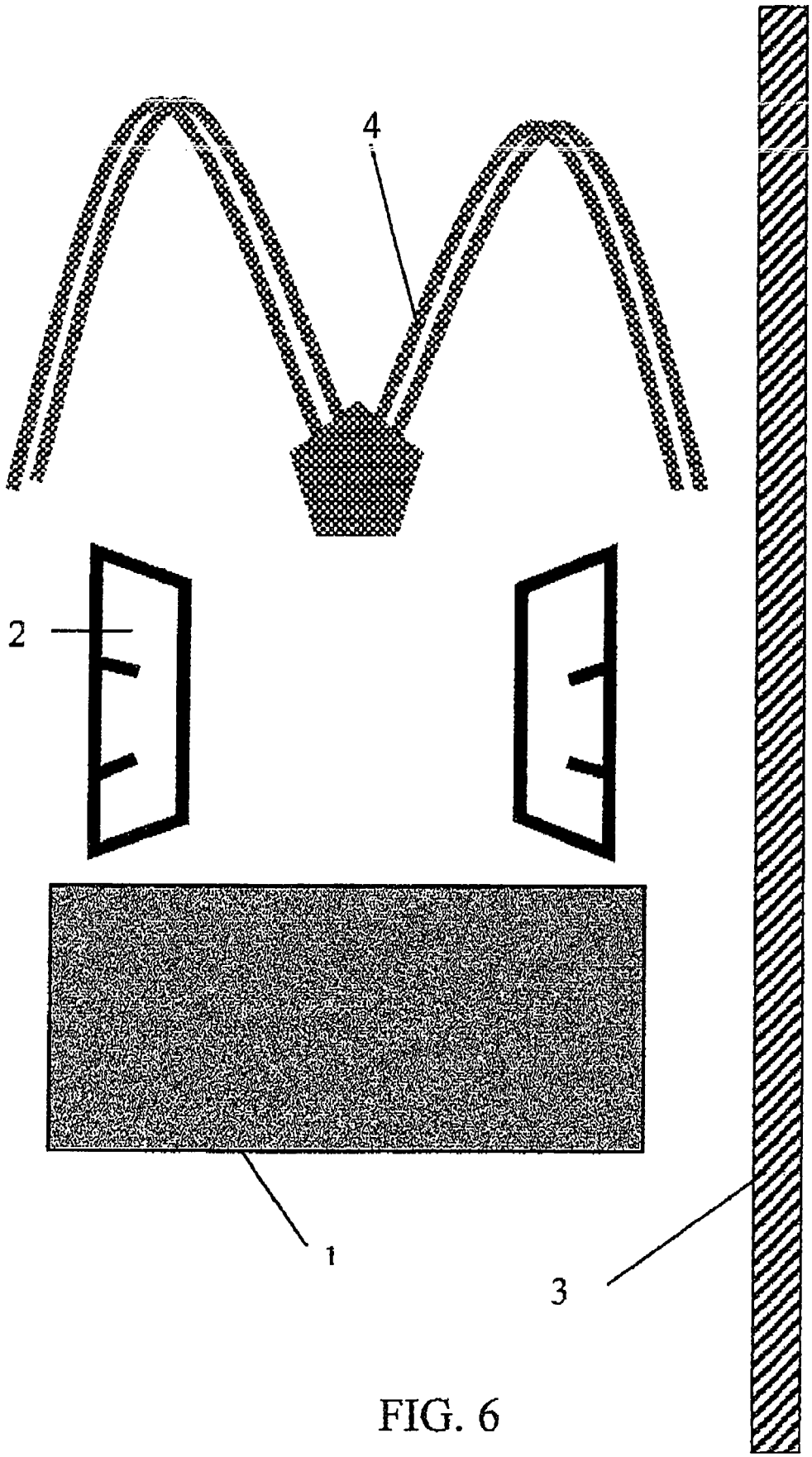
FIG. 6 represents the device's elements.
Figure 7:
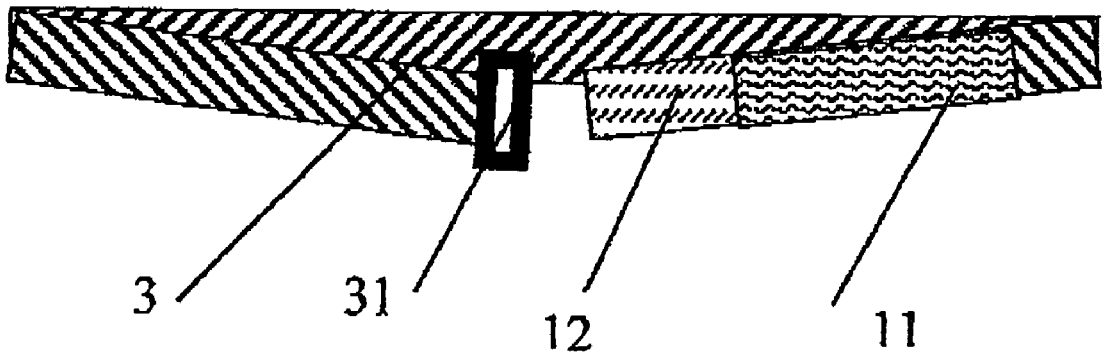
FIGS. 7, 8, 9, 10, 11 and 12 represent, for variants of this device, different embodiments of the lumbar band, strap and rings.
Figure 8:
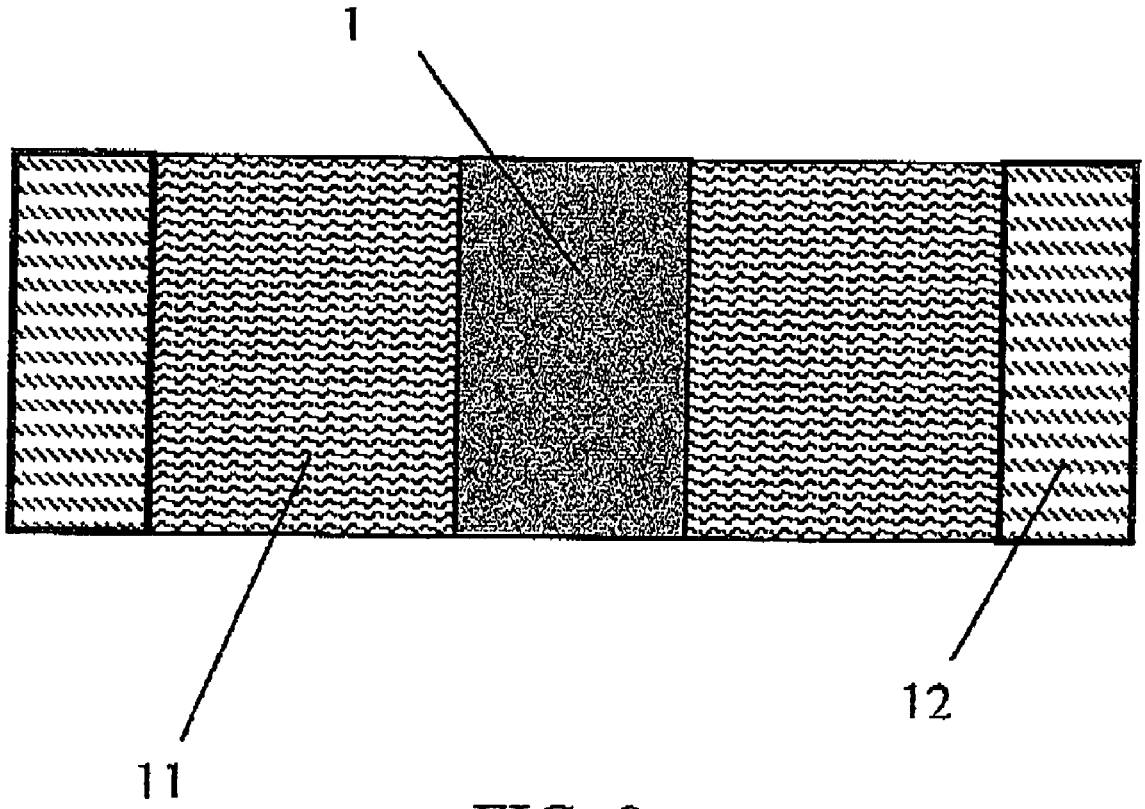

Referring now to drawings 3 and 4, the rings divided into three parts (a), (b) and (c) permit staged work in all the abdominal muscles. Symmetrical work can be done on three stages by inserting the strap at the same level in the two rings (FIG. 3). Asymmetrical work can be done on the right side and on the left side by inserting the strap in two different levels (FIG. 4). Since the teeth (21) do not cover the entire width of the ring, they allow the strap to slide from one level to another.

Referring now to drawing 5, the device according to the invention performs the following biomechanical functions: when the device is worn and adjusted and the strap inserted in the rings, the device operates by pulling with both hands (a) on the strap (3), breathing out (d) and trying to hold the stomach in as much as possible (b). The tightened strap (g) supports the abdominal muscles which go in (b). The movement of the arms (a) and the pulling of the strap (g) encourage diaphragmatic breathing which offers a greater amplitude to the abdominal work (b) and optimal oxygenation (d). Tightened by the action of the hands pulling the strap (3), the lumbar band (1) supports the back and corrects posture (e).

Referring now to drawings 1 and 7 which illustrate a variant of the device, the strap (3) can have technical looping and adjusting features such as, by way of non-exhaustive examples, a small loop (31) and self-fastening fabrics (11) with loops and hooks (12).

Referring now to drawings 2 and 8 which illustrate variants of the device, the lumbar band (1) can have technical fixing and adjusting features such as self-fastening fabrics (non-exhaustive example). The fabrics with loops (11) fix on the outer face of the lumbar band. The hook parts (12) are added to the ends of this band.

Figure 9:
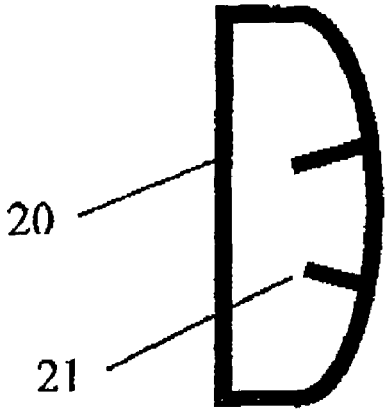
Figure 10:
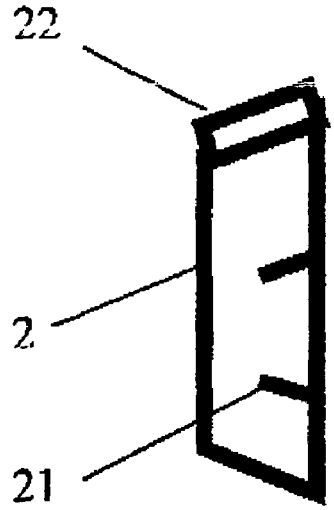
Figure 11:
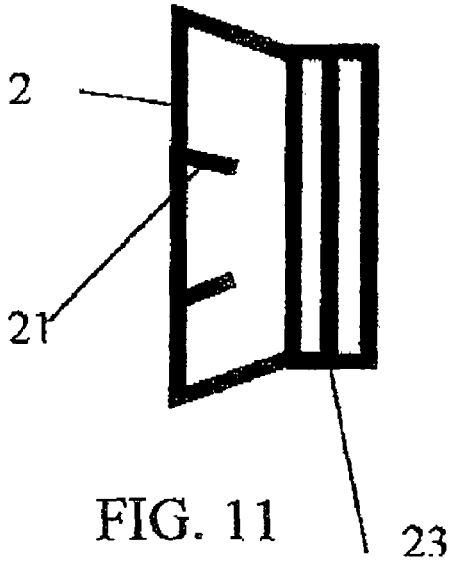
Figure 12:
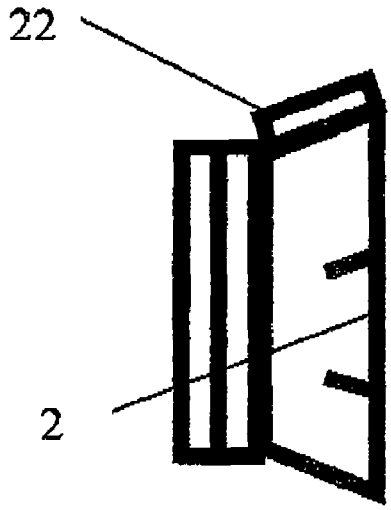

Referring now to drawings 2, 9, 10, 11 and 12 which illustrate variants of the device, the ring (2) can be joined to an adjusting and fixing mechanism such as a loop for adjusting braces (23) (non-exhaustive example). Equally, the ring (2) can be provided with a hole (22) at the top to attach the ends of the braces (41) and it can have various shapes. The example of a circular shape (20) illustrated in FIG. 9 is non-exhaustive.

Referring now to drawing 2 which illustrates a variant of the device, the technical adjusting features can be added both to the lumbar band (1) as in (11) and (12) and to the rings (2) as in (23).

As a non-exhaustive example and for a non-adjustable adult medium size model with rectangular plastic rings, having the strap as well as the lumbar band made of thick fabrics, the dimensions can be as follows: the lumbar band will measure about 50 cm×20 cm×0.3 cm. The strap will have the approximate dimensions 120 cm×4 cm×.03 cm. The ring, of variable thickness and width according to the material, will measure in this example about 25 cm×7 cm×1.5 cm. The teeth of the rings will measure 3 cm. The height of the stages will be about 6 cm.

This device according to the invention is intended for any person wishing to tone up his abdominal muscles without fatigue and safely for the back. More particularly, it will be suitable for people who are beginning exercising who are not used to physical effort and who have the major impediments of lumbar pain or obesity.

The invention claimed is:

1. Device for working specifically the abdominal muscles of an user, and more particularly the transverse muscle, thereof said device comprising a flexible lumbar having two opposite transversal end portions, two rigid rings respectively fixed to said transversal end portion over the entire length thereof each of said rings having at least one tooth which delimits into the ring at least two staged parts, two braces each having a first end fixed to one of said rings and a second end attached to a middle area of said lumbar band and a flexible strap passing through two parts of said rings at selected level while forming with the lumbar band a closed loop.

2. Device as claimed in claim 1 wherein said rings are respectively provided with two internal teeth which define into said ring three distinct passages, said ring being fixed on two opposite parts of said band, said band being conceived so as to pass through one passage of each ring.

3. Device according to claim 1 wherein said band is made of rigid, flexible material.

4. Device according to claim 1 wherein strap is made of rigid, flexible material and goes round the abdomen user.

5. Device according to claim 1 wherein said maintaining means comprising a self adjusting and fixing mechanism provided on said band and on said strap.

6. Device according to claim 5 wherein said adjusting and fixing mechanism comprise at least a self-fastening fabric with loops and self-fastening fabric with hooks.

7. Device according to claim 5 wherein said strap has one end portion which is provided with a small loop.

8. Device according to claim 1 which comprises means for adjusting the length of said band.

* * * * *